United States Patent [19]

Wheeler

[11] 4,043,475

[45] Aug. 23, 1977

[54] CAPS AND CONTAINERS

[75] Inventor: Eric Charles Wheeler, Bexleyheath, England

[73] Assignee: Glyndon Plastics Limited, London, England

[21] Appl. No.: 732,896

[22] Filed: Oct. 15, 1976

[51] Int. Cl.[2] ..... B65D 55/02; B65D 85/56; A61J 1/00

[52] U.S. Cl. ..... 215/223; 215/206; 215/224; 215/256; 222/546

[58] Field of Search ..... 215/206, 223, 224, 256; 222/546

[56] References Cited

U.S. PATENT DOCUMENTS 3,877,598 4/1975 Hazard ..... 215/224

3,980,194 9/1976 Costa ..... 215/223

*Primary Examiner*—George T. Hall

[57] ABSTRACT

A cap and container assembly which is both tamper-proof and child-resistant comprises a container neck with first and second external beads, the first bead extending only part way round the neck and having a lug midway between its ends, and the cap has an internal bead with a gap in it matching the lug and also has a tear-off strip connected to a shoulder that engages under the second bead on the neck so that even after removal of the strip the cap still has to be turned to bring the gap opposite the lug before it can be removed. The shoulder may be on an anchor band which fits permanently under the second bead. The cap may be permanently joined to this anchor band by a hinge web.

7 Claims, 8 Drawing Figures

CAPS AND CONTAINERS

This invention relates to containers, for example for pills or medicines, and caps for fitting to such containers.

It is known to make closures on containers tamper-proof by providing an integral tear-off strip on the cap, this strip having to be torn off before the cap can be removed. Various proposals have also been made, especially in recent years, to make closures for containers for pills or medicines child-resistant by arranging that the cap is secured in a way that a child's hand is incapable of disengaging, or that requires the user to read instructions. The aim of the present invention is to provide a novel kind of cap and container assembly which is both tamper-proof and child-proof, i.e. in which, even after removal of the tear off strip, the cap can only be removed with ease by an adult.

According to the invention there is provided a cap and container assembly comprising a container having a cylindrical neck portion on the outside of which are provided two annular beads, the one nearer to the rim of the mouth extending only partially around the circumference of the neck, there being an outwardly projecting lug on the neck, at the level of the partial bead, substantially mid-way between the ends of the partial bead, and a cap having a top wall portion and a depending skirt, the skirt having near its lower edge an inwardly directed bead designed to engage, when the cap is fitted onto the neck to close the container, under the partial bead on the neck of the container and under the lug, this inwardly directed bead having in it a circumferential gap equal in length to slightly more than the circumferential length of the lug, the shape in profile of the partial bead, the lug and the inwardly directed bead and the resilience of the material of at least the skirt of the cap being such that when the cap is forcibly applied to the neck of the container in any relative angular position the inwardly directed bead will snap over the partial bead and the lug to retain the cap in position on the container, the cap being thereafter removable only if it is first turned to an angular position in which the gap in the inwardly directed bead is aligned with the lug, in which position the adjacent region of the cap can be flexed upwards sufficiently to allow the inwardly directed bead to be disengaged progressively from the partial bead, the lower edge of the skirt of the cap being furthermore joined by a frangible web or webs to a circumferentially extending tear-off strip which is connected directly or indirectly to an inwardly directed circumferentially extending shoulder which, when the cap is first fitted to the container, engages under the second bead on the neck of the container to prevent removal of the cap, regardless of its angular position in relation to the container, until the tear-off strip is at least partially detached.

The tear-off strip may have the shoulder provided on its own inside surface, for example immediately adjacent to the frangible web. Alternatively the shoulder may be provided on an anchor ring which encloses the neck of the container under the second bead and is joined to the tear-off strip by a further frangible web or webs; thus the tear-off strip forms a connecting link between the anchor band and the cap, and on detachment of the strip the anchor ring remains in place. According to a further feature of the invention the cap and the anchor ring remain connected together by a web that forms a hinge, after detachment of the tear-off strip. In that case the anchor ring must be sufficiently loose on the neck of the container to allow the cap and anchor ring to be turned by the user to the required angular position for opening the cap.

According to a further feature of the invention cooperating marks on the outside of the cap and on the neck of the container indicate to the adult user the required angular position, and the mark on the neck is concealed by the tear-off strip until the strip is detached. The mark on the cap may be formed by an outwardly projecting tab provided to facilitate lifting of the cap, this tab being at the same circumferential position on the cap as the gap in the bead inside.

To reduce the chance of a child unconsciously detecting the required angular position for release by rotating the cap whilst maintaining an upward load on the cap, so that the lug on the neck enters the gap in the bead or the cap, the mouth of the gap may be bridged by a shallow rib of a height sufficient to prevent such entry under light loading, but not sufficient to prevent passage of the lug when a determined lifting action is exerted on that part of the cap by an adult user who knows he has turned the cap to the right position.

The invention will now be further explained by way of example with reference to the accompanying drawings, which show two embodiments. In the drawings.

Figure 1:
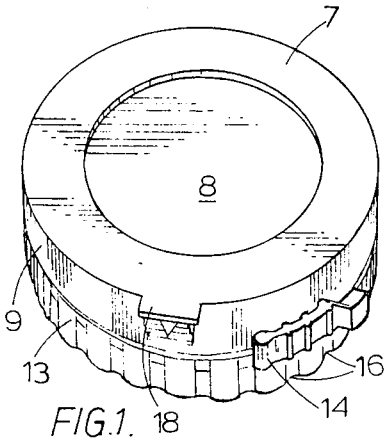
FIG. 1 is a three-quarter view from above of the cap of a first embodiment.
Figure 3:
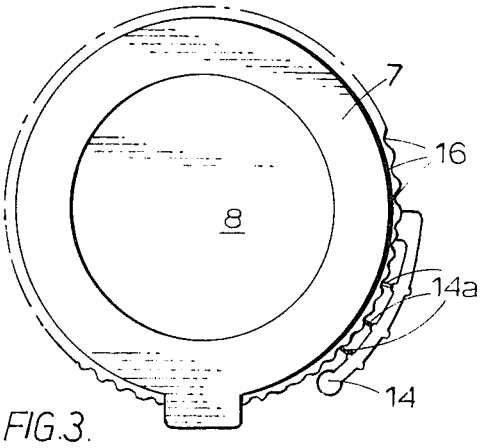
FIG. 3 is a plan view of the cap from above.
Figure 2:
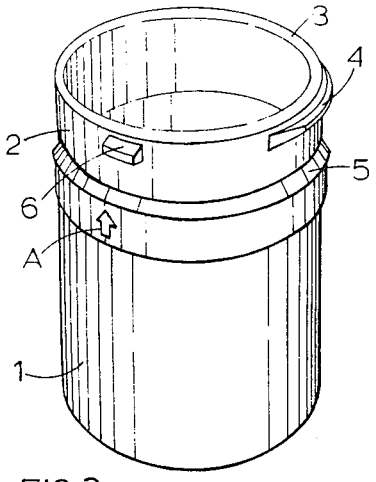
FIG. 2 is a three-quarter view of the container of this embodiment.
Figure 4:
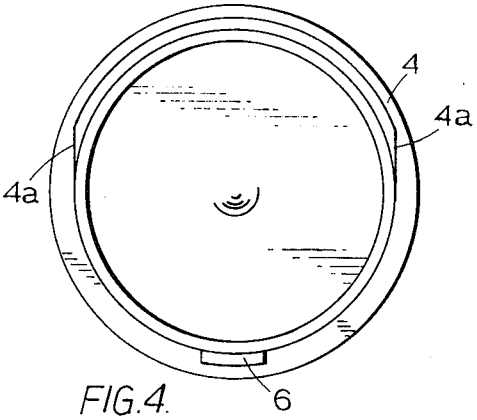
FIG. 4 is a plan view of the container from above.
Figure 5:
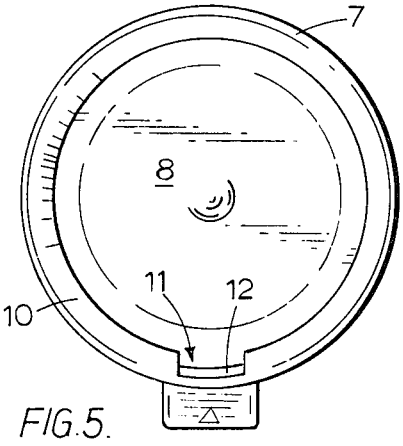
FIG. 5 is an inverted plan view of the cap, after removal of the tear-off strip.
Figure 6:
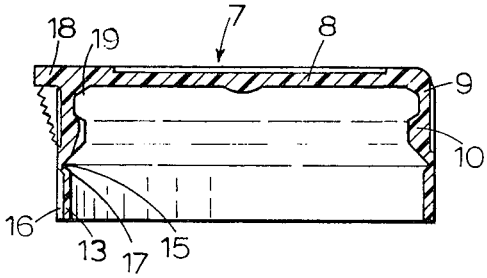
FIG. 6 is a section through the cap on the line 6—6 in FIG. 5.

Referring first to FIGS. 1 to 6, a container 1, for example for pills, has a cylindrical neck portion 2 with a rim 3 and, just below the rim, two circumferentially extending beads 4 and 5. The bead 4, nearer the rim 3 is only a partial one, extending just under half way round the neck and, as shown in FIG. 4, it tapers away smoothly at its two ends 4*a*. Midway between these two ends and at the same level, i.e. the same distance from the rim 3, is an outwardly projecting lug 6, of substantially the same radial extent as the bead 4. The second bead 5 is unbroken and has a downwardly facing sawtooth profile.

A cap 7 has a substantially flat top wall 8 and a depending skirt 9. On the inside surface of the skirt is an inwardly directed bead 10, continuous except for a gap 11 (FIG. 5) slightly greater in circumferential extent than the lug 6 referred to above. Extending across the gap 11 is a shallow bridging rib 12, of much smaller radial depth than the bead 10.

Joined to the lower edge of the skirt 9 is a circumferentially extending tear-off strip 13, provided with a tab 14 for the user to grasp to detach it. The connection between the skirt and the tab may be in accordance with our British Patent Specification No. 1,377,616, in which the weakened line is formed by the intersection of a circumferential groove on one side of the wall with a series of circumferentially spaced notches on the other side. However preferably the groove, shown at 15, and the notches 16 do not quite intersect.

The cap 7 is of material, preferably a synthetic resin such as polyethylene, that is sufficiently resilient to allow it to be forced onto the container by automatic machinery. The bead 10 engages under the upper bead 4 on the neck of the container and a shoulder 17 at the upper edge of the tear-off strip 13 engages under the saw-tooth profile of the lower bead 5.

In this condition the cap cannot be removed, regardless of its angular position. First the user must grasp the tab 14 to pull off the strip 13. The integrity of this strip assures the user that up until he tears it off, the contents of the container have not been touched. In the example shown, the tab 14 is joined to the cap by breakable webs 14*a* (FIG. 3).

However, even after removal of the strip 13 the cap still cannot be removed until it is first turned to an angular position, in relation to the container, such that the gap 11 in its internal bead 10 is brought into alignment with the lug 6. The beads are, of course invisible, but an arrow A or other index mark provided on the outside of the neck 2 below the lower bead 5 to show the position of the lug 6. This mark is concealed by the strip 13 until that strip is removed. Written instructions on the top of the cap indicate to the user that to open the container he has to turn the cap to bring an external lug 18 on the cap into alignment with this mark. A small child, unable to read the instructions, will not be able to remove the cap unless by chance it happens to be in the right angular position. If a child is turning the cap and at the same time pressing upwards on the lug 18 he might find the gap 11 by chance were it not for the presence of the rib 12. This rib prevents accidental entry of the lug 6 into the gap. Yet when a user knows he has turned the cap to the right position, a determined upward push on the lug 18 will force the lug 6 past the rib 12. The cap will flex, and that half of it in which the gap 11 lies can come clear of the container easily because of the absence of the bead 4 on the part of the container neck below this half. By the time the cap is half off, the cap can move laterally, allowing the bead 10 to disengage itself from the bead 4, (this being assisted by the tapering of the ends 4*a* of that bead) and the cap comes free.

It will be understood that the shape and radial depth of the beads 10 and 4 and the flexibility of the material of the cap 7 are selected to ensure easy removal without making it so easy that the bead 10 could be forced over the bead 4 by the application of an upward force at a point remote from the lug 18.

Fluid tightness of the cap is assured by an inclined surface 19 on the inside of the cap, designed to engage tightly the mouth of the neck 2.

It is important to note that, after removal, the cap 7 can be snapped back onto the container in any angular position and so even if no positive action is taken by the user to turn the cap in order to ensure that it is child-resistant thereafter, the chances are high that the lug 6 and gap 11 are not in line, making the child-resistance automatic.

Figure 7:
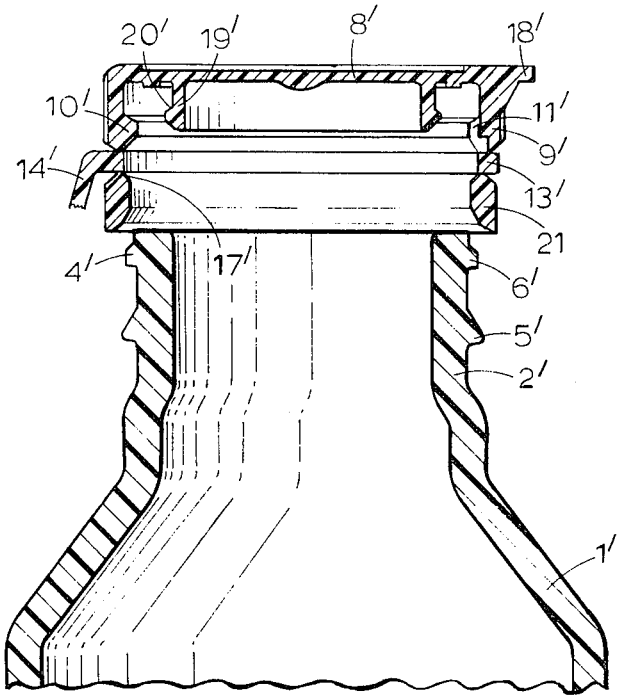
FIG. 7 is a vertical section through the upper part of a container and cap in accordance with a second embodiment, before the cap is fitted to the container.
Figure 8:
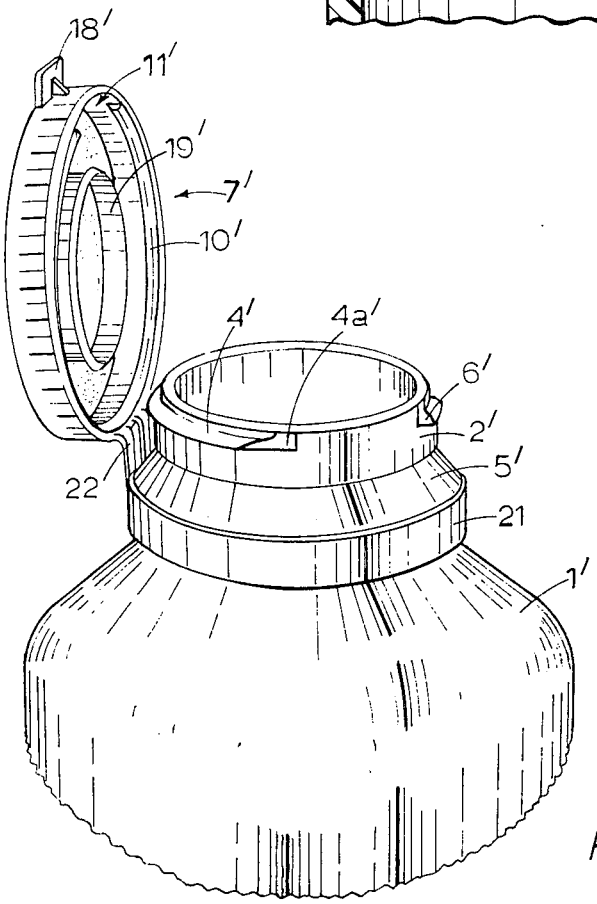
FIG. 8 shows the container and cap of FIG. 7 after opening.

FIGS. 7 and 8 show an alternative embodiment in which the same reference numerals, but with indices added, have been used for parts which correspond to those in the embodiment of FIGS. 1 to 6. The chief difference is that there is an anchor band 21 which remains permanently in position by virtue of a shoulder 17' on it engaging under the lower bead 5' on the neck of the container. A tear-off strip 13' has its upper edge detachably connected to the skirt 9 of the cap and its lower edge similarly connected to the anchor ring 21. Moreover the strip 13' does not extend all the way round the cap; on the contrary there is a gap that is bridged by a hinge web 22 which permanently connects the cap 7' to the ring 21, even after removal of the strip 13', at a point diametrically opposite the lug 18' and the gap 11'. The construction as far as the strip 13' and hinge web 22 are concerned may be similar to that shown in U.S. Pat. No. 2,990,077.

The behaviour of the embodiment of FIGS. 7 to 8 is similar to that of the first embodiment except that the cap remains hinged to the container at all times. This means that when he closes the cap it will generally be in the same angular position in relation to the container as it was when opened, so after closing the cap the user has to take a positive step to make it child-resistant thereafter, namely he has to turn it (complete with the anchor ring 21) by an arbitrary amount to bring the gap 11' out of line with the lug 6'.

It would, of course, be possible to turn the anchor ring on the container while the cap is open, and if that is done it is still possible, as in the earlier embodiment, to close the cap onto the container regardless of its angular position.

In the embodiment of FIGS. 7 and 8 the fluid-tightness is achieved by a downwardly extending integral internal flange 19' on the cap, with a bead 20' on the outside of its lower end to seal inside the mouth of the neck 2'. Such a sealing arrangement could also be used in the version of FIGS. 1 to 6, instead of, or in addition to, the surface 19.

I claim:

1. A cap and container assembly comprising a container having a cylindrical neck portion on the outside of which are provided first and second annular beads, said first bead being nearer to the rim of said neck than said second bead and extending only partially around the circumference of said neck, there being an outwardly projecting lug on said neck, at the level of said first bead, substantially midway between the ends of said first bead, and a cap having a top wall portion and a depending skirt, said skirt having near the lower edge thereof an inwardly directed third bead designed to engage, when said cap is fitted onto the neck to close said container, under said first bead on said neck of said container and under said lug, said third bead having therein a circumferential gap equal in length to slightly more than the circumferential length of said lug, the shape in profile of said first bead, said lug and said third bead and the resilience of the material of at least the skirt of said cap being such that when said cap is forcibly applied to the neck of said container in any relative angular position said third bead will snap over said first bead and said lug to retain said cap in position on said container, the cap being thereafter removable only if it is first turned to an angular position in which said gap in said third bead is aligned with said lug, in which position the adjacent region of the cap can be flexed upwards sufficiently to allow said third bead to be disengaged progressively from said first bead, the lower edge of the skirt of said cap being furthermore joined by frangible web means to a circumferentially extending tear-off strip which is connected directly or indirectly to an inwardly directed circumferentially extending shoulder which, when said cap is first fitted to said container, engages under said second bead on the neck of the container to prevent removal of said cap, regardless of the angular position thereof in relation to said container, until said tear-off strip is at least partially detached.

2. The cap and container assembly set forth in claim 1 wherein said shoulder is provided on said tear-off strip itself and after removal of said strip said cap can be completely detached from said container.

3. The cap and container assembly set forth in claim 1 wherein said shoulder is provided on an anchor strip which remains on the neck of said container after removal of said tear-off strip.

4. The cap and container assembly set forth in claim 3 wherein said cap remains attached to said anchor ring by a hinge web after removal of said tear-off strip, said hinge web lying diametrically opposite said gap in said third bead, and said anchor ring, complete with the cap, is capable of being turned with respect to the neck of said container.

5. The cap and container assembly set forth in claim 1 wherein co-operating marks are provided on said cap and on the neck of said container to indicate the angular position to which said cap must be brought to allow removal thereof and wherein said mark on the neck of said container is concealed by said tear-off strip until said strip is detached.

6. The cap and container assembly set forth in claim 1 wherein the resilience of the material of said cap and the shape and radial depth of said first bead on the neck of the container and said third bead in the cap are such that said cap can be fitted onto said container in any relative angular position.

7. The cap and container assembly set forth in claim 1 wherein said gap in said third bead is bridged by a rib which is radially shallower than said third bead but which prevents entry into said gap by said lug on the neck of the container except in the presence of a substantial force applied to said cap at the appropriate position.

* * * * *